US007682499B2

(12) United States Patent
Holmes et al.

(10) Patent No.: US 7,682,499 B2
(45) Date of Patent: Mar. 23, 2010

(54) MINERAL INSULATING OIL, A PROCESS FOR PREPARING A MINERAL INSULATING OIL, AND A PROCESS FOR USING A MINERAL INSULATING OIL

(75) Inventors: Steven Allen Holmes, Houston, TX (US); Ronald Wayne Dever, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 537 days.

(21) Appl. No.: 11/466,856

(22) Filed: Aug. 24, 2006

(65) Prior Publication Data

US 2007/0197405 A1 Aug. 23, 2007

Related U.S. Application Data

(60) Provisional application No. 60/712,867, filed on Aug. 31, 2005, provisional application No. 60/717,385, filed on Sep. 15, 2005.

(51) Int. Cl.
*C10M 169/04* (2006.01)

(52) U.S. Cl. ..... 208/19; 208/14; 585/1; 585/6.3; 585/6.6; 585/7; 585/13

(58) Field of Classification Search ..... 208/18, 208/19, 14; 508/110, 111; 585/1, 6.3, 6.6, 585/7, 13

See application file for complete search history.

(56) References Cited

U.S. PATENT DOCUMENTS 3,715,302 A * 2/1973 Mills et al. ..... 208/14
3,791,959 A * 2/1974 Mills et al ..... 208/19
3,912,617 A * 10/1975 Mills et al. ..... 208/14
4,082,866 A * 4/1978 Link ..... 427/294
4,324,933 A 4/1982 Kimura et al. ..... 585/6.6
6,355,850 B1 3/2002 Angelo et al. ..... 585/6.6

FOREIGN PATENT DOCUMENTS

GB 2002027 A 2/1979
WO WO0154138 A1 7/2001

OTHER PUBLICATIONS

Laredo, G.C. et al. (2002). Fuel, 81, 1341-1350.*
Sevast'yanov, G.V. et al (1978). Chemistry and Technology of Fuels and Oils, 14(7), 467-470.*
PCT—US2006/033873—International Search Report dated Jan. 22, 2007.
PCT—US2006/033873—Written Opinion.

* cited by examiner

*Primary Examiner*—Robert J Hill, Jr.
*Assistant Examiner*—Brian McCaig

(57) ABSTRACT

The invention provides for a mineral insulating oil having a naphthenic base oil and a paraffinic base oil wherein the naphthenic base oil includes a ratio of total sulfur to basic nitrogen of less than about 80:1. The invention also provides for a mineral insulating oil having a naphthenic base oil, a paraffinic base oil, and an antioxidant agent wherein the naphthenic base oil includes a ratio of total sulfur to basic nitrogen of less than about 80:1. The invention also provides for a process for producing a mineral insulating oil including contacting a naphthenic base oil and a paraffinic base oil wherein the naphthenic base oil includes a ratio of total sulfur to basic nitrogen of less than about 80:1. The invention also provides for a process for producing a mineral insulating oil including contacting a naphthenic base oil, a paraffinic base oil, and an antioxidant agent wherein the naphthenic base oil includes a ratio of total sulfur to basic nitrogen of less than about 80:1.

16 Claims, No Drawings

MINERAL INSULATING OIL, A PROCESS FOR PREPARING A MINERAL INSULATING OIL, AND A PROCESS FOR USING A MINERAL INSULATING OIL

CROSS-REFERENCE TO RELATED APPLICATIONS

This application claims the benefit of U.S. Provisional Application No. 60/712,867 filed Aug. 31, 2005, and U.S. Provisional Application No. 60/717,385 filed Sep. 15, 2005, which are incorporated herein by reference.

FIELD OF THE INVENTION

The invention relates to a mineral insulating oil, a process for preparing a mineral insulating oil, and a process for using a mineral insulating oil.

BACKGROUND OF THE INVENTION

Many types of electrical equipment contain a mineral insulating oil for dissipating the heat generated by energized components, for insulating the energized components from the equipment enclosure and from other internal parts and devices, and combinations thereof. Examples of electrical equipment include, but are not limited to, transformers, capacitors, switches, regulators, circuit breakers, cables, reclosers, x-ray equipment, and combinations thereof.

A transformer generally transfers electric power from one circuit to another electromagnetically. Transformers are generally used in the transmission of electrical power. Large transformers generally require insulation of coils, conductors, and combinations thereof, in order to protect the transformer at normal operating voltages, during temperature overvoltages, during transient overvoltages, and combinations thereof. Transient overvoltages may result from lightning strikes, switching operations, and combinations thereof. When insulation fails, an internal fault or short circuit may occur. Such occurrences may cause the equipment to fail, typically leading to system outages and possibly endangering persons in the vicinity of the equipment.

In order to effectively transfer heat away from a transformer core and coil assembly and to maintain an acceptable operating temperature, conventional transformers use relatively large volumes of a mineral insulating oil as insulation.

In the past, mineral insulating oils made from naphthenic or paraffinic base oils tended to have inherently poor low temperature viscometric properties and generally did not exhibit low gassing performance as required by American Standard Test Method (ASTM) D3487 for Type I mineral insulating oils.

In addition, the gassing tendency of a mineral insulating oil is a measure of the rate of absorption or desorption of hydrogen into or out of the mineral insulating oil under prescribed laboratory conditions. Low gassing performance is important because, if hydrogen is evolved due to electrical stress, a liquid having low gassing tendency tends to absorb the evolved hydrogen and thereby reduce the chances of an explosion.

Naphthenic base oils and paraffinic base oils may be designed for use in mineral insulating oil applications. Naphthenic base oils may need to be chemically inhibited to control oxidation tendencies in meeting industrial requirements. Naphthenic base oils have good low temperature properties due to low wax concentrations. Whereas many paraffinic base oils are oxidatively stable, the paraffinic base oils have high positive gassing tendencies and poor low temperature performance (high pour point) in mineral insulating oil applications.

U.S. Pat. No. 6,355,850 B1 to Angelo et al. discloses that electrical oils having improved uninhibited oxidation and electrical resistance are derived by blending a substantially nitrogen and sulfur free paraffinic or naphthenic base oil with a hydrofined light gas oil having a sulfur to nitrogen weight ratio of greater than 100:1 wherein the hydrofined light gas oil is added to the base oil in an amount sufficient to provide a blend having greater than about 0.03 wt % sulfur.

There is a need for a mineral insulating oil that provides, for example, low temperature performance, retains good gassing tendency, and exhibits oxidation stability.

There is also a need for a mineral insulating oil that meets the requirements of various standards, for example, "Fluids for Electrotechnical Applications—Unused Mineral Insulating Oils for Transformers and Switchgears" (CEI IEC 60296) and the Standard Specification of Mineral Insulating Oil Used in Electrical Apparatus (ASTM D3487 Type I).

SUMMARY OF THE INVENTION

The invention provides for a mineral insulating oil comprising a naphthenic base oil and a paraffinic base oil wherein the naphthenic base oil comprises a ratio of total sulfur to basic nitrogen of less than about 80:1.

The invention also provides for a mineral insulating oil comprising a naphthenic base oil, a paraffinic base oil, and an antioxidant agent wherein the naphthenic base oil comprises a ratio of total sulfur to basic nitrogen of less than about 80:1.

The invention also provides for a process for producing a mineral insulating oil comprising contacting a naphthenic base oil and a paraffinic base oil wherein the naphthenic base oil comprises a ratio of total sulfur to basic nitrogen of less than about 80:1.

The invention also provides for a process for producing a mineral insulating oil comprising contacting a naphthenic base oil, a paraffinic base oil, and an antioxidant agent wherein the naphthenic base oil comprises a ratio of total sulfur to basic nitrogen of less than about 80:1.

DETAILED DESCRIPTION OF THE INVENTION

A process of the invention comprises contacting, preferably blending, a naphthenic base oil and a paraffinic base oil to provide for a mineral insulating oil of the invention comprising one or more of the characteristics as described herein. Another process of the invention comprises contacting, preferably blending, a naphthenic base oil, a paraffinic base oil, and an antioxidant agent to provide for a mineral insulating oil of the invention comprising one or more of the characteristics as described herein.

Contacting of a naphthenic base oil and a paraffinic base oil may be performed by mechanical stirring. For example, a mineral insulating oil of the invention may be produced by blending a naphthenic base oil and a paraffinic base oil in-situ during the preparation of a mineral insulating oil of the invention. Contacting of a naphthenic base oil, a paraffinic base oil, and an antioxidant agent may be performed by mechanical stirring. For example, a mineral insulating oil of the invention may be produced by blending a naphthenic base oil, a paraffinic base oil, and an antioxidant agent in-situ during the preparation of a mineral insulating oil of the invention.

Contacting of a naphthenic base oil, a paraffinic base oil, and one or more additional components, for example, but not limited to, a pour point depressant, an anti-gassing agent, and combinations thereof, may be conducted in any order, including simultaneously, to provide for a mineral insulating oil of the invention. An example process of preparing a mineral insulating oil of the invention generally comprises contacting a naphthenic base oil and a paraffinic base oil to provide for a composition, preferably a blend, comprising a naphthenic base oil and a paraffinic base oil. The composition comprising a naphthenic base oil and a paraffinic base oil may then be subjected to contacting with a component selected from the group consisting of a pour point depressant, an anti-gassing agent, and combinations thereof.

Contacting of a naphthenic base oil, a paraffinic base oil, and an antioxidant agent may be conducted in any order, including simultaneously, to provide for a mineral insulating oil of the invention. Contacting may also include contacting with one or more additional components, for example, but not limited to, a pour point depressant, an anti-gassing agent, and combinations thereof. An example process of preparing a mineral insulating oil of the invention generally comprises contacting a naphthenic base oil and a paraffinic base oil to provide for a composition, preferably a blend, comprising a naphthenic base oil and a paraffinic base oil. The composition comprising a naphthenic base oil and a paraffinic base oil may then be subjected to contacting with an antioxidant agent. In addition to contacting with an antioxidant agent, the composition comprising a naphthenic base oil and a paraffinic base oil may be contacted with a component selected from the group consisting of a pour point depressant, an anti-gassing agent, and combinations thereof.

Contacting of a naphthenic base oil and a paraffinic base oil to provide for a mineral insulating oil of the invention generally comprises a temperature, a pressure, and a time period that suitably provides for a mineral insulating oil of the invention. Contacting of a naphthenic base oil and a paraffinic base oil provides for a mineral insulating oil of the invention. Contacting of a naphthenic base oil, a paraffinic base oil, and an antioxidant agent to provide for a mineral insulating oil of the invention generally comprises a temperature, a pressure, and a time period that suitably provides for a mineral insulating oil of the invention. Contacting of a naphthenic base oil, a paraffinic base oil, and an antioxidant agent provides for a mineral insulating oil of the invention. Examples of suitable contacting include, but are not limited to, blending, mixing, stirring, circulating, and combinations thereof, preferably blending.

Contacting may be conducted using any means that provides for a mineral insulating oil of the invention. Examples of suitable means for contacting include, but are not limited to, blenders, mixers, mechanical stirrers, and combinations thereof.

The temperature during contacting may be any temperature that suitably provides for a mineral insulating oil of the invention and is generally a temperature found in base oil blending techniques. The contacting of a naphthenic base oil and a paraffinic base oil may be conducted below the flash point of the naphthenic base oil and the paraffinic base oil. The contacting process may be conducted at room temperature (about 25° C.). Generally, the temperature is in a range of from about 5° C. to about 100° C., preferably in a range of from about 10° C. to about 90° C., and more preferably in a range of from about 20° C. to about 80° C.

The pressure during contacting may be any pressure that suitably provides for a mineral insulating oil of the invention and is generally a pressure found in base oil blending techniques. The pressure which the contacting process is performed under is not critical and may be performed under vacuum conditions or extreme pressures. The contacting process may be performed at atmospheric pressure. Generally, the pressure is in a range of from about atmospheric (about 0 kPa) to about 1460 kPa, preferably in a range of from about 0 kPa to about 700 kPa, and more preferably in a range of from about 0 kPa to about 350 kPa.

The time period during contacting may be any time period that suitably provides for a mineral insulating oil of the invention and is generally a time period found in base oil blending techniques. Generally, the time period is in a range of from about 0.25 hours to about 8 hours, preferably in a range of from about 0.5 hour to about 6 hours, and more preferably in a range of from about 0.5 hour to about 3 hours.

The temperatures, pressures, and time periods disclosed herein are also applicable when, for example, contacting a naphthenic base oil and a paraffinic base oil to provide for a composition, preferably a blend, comprising a naphthenic base oil and a paraffinic base oil that may then be subjected to a contacting with a component selected from the group consisting of a pour point depressant, an anti-gassing agent, and combinations thereof, as well as when contacting a naphthenic base oil, a paraffinic base oil and one or more components simultaneously.

The temperatures, pressures, and time periods disclosed herein are applicable when, for example, contacting a naphthenic base oil and a paraffinic base oil to provide for a composition, preferably a blend, comprising a naphthenic base oil and a paraffinic base oil that may then be subjected to a contacting with an antioxidant agent as well as when simultaneously contacting a naphthenic base oil, a paraffinic base oil, and an antioxidant agent. The temperatures, pressures, and time periods disclosed herein are also applicable when, for example, contacting a naphthenic base oil, a paraffinic base oil, and an antioxidant agent to provide for a composition, preferably a blend, comprising a naphthenic base oil, a paraffinic base oil, and an antioxidant agent, that may then be subjected to contacting with a component selected from the group consisting of a pour point depressant, an anti-gassing agent, and combinations thereof, as well as when simultaneously contacting a naphthenic base oil, a paraffinic base oil, an antioxidant agent, and a component selected from the group consisting of a pour point depressant, an anti-gassing agent, and combinations thereof.

A mineral insulating oil of the invention generally comprises a naphthenic base oil in any amount that suitably provides for a mineral insulating oil of the invention. A mineral insulating oil of the invention comprises an amount of naphthenic base oil based on the total weight of the mineral insulating oil generally in a range of from about 60 weight percent to about 95 weight percent, preferably in a range of from about 65 weight percent to about 90 weight percent, and more preferably in a range of from about 70 weight percent to about 85 weight percent.

A mineral insulating oil of the invention generally comprises a paraffinic base oil in any amount that suitably provides for a mineral insulating oil of the invention. A mineral insulating oil of the invention comprises an amount of paraffinic base oil based on the total weight of the mineral insulating oil generally in a range of from about 5 weight percent to about 40 weight percent, preferably in a range of from about 10 weight percent to about 35 weight percent, and more preferably in a range of from about 15 weight percent to about 30 weight percent.

An antioxidant agent may be added to a mineral insulating oil of the invention to improve oxidation stability, thereby minimizing the development of oil sludge and acidity during storage, processing, service, and combinations thereof. Minimizing oxidation may minimize electrical conduction and metal corrosion. Minimizing oxidation may also maximize system life and may maximize electrical breakdown strength. Minimizing oxidation may help ensure satisfactory heat transfer.

Whereas an antioxidant agent may be added to a mineral insulating oil of the invention, an advantage of the invention is that an antioxidant agent may not be added. When an antioxidant agent is not present, a mineral insulating oil of the invention is generally referred to as uninhibited. When an antioxidant agent is present, a mineral insulating oil of the invention is generally referred to as inhibited. The amount of sulfide sulfur present in an uninhibited mineral insulating oil of the invention may provide for oxidation inhibition and the uninhibited mineral insulating oil may exhibit excellent oxidation stability. The amount of an antioxidant agent present in an inhibited mineral insulating oil of the invention may provide for oxidation inhibition and the inhibited mineral insulating oil may exhibit excellent oxidation stability.

If an antioxidant agent is added, an inhibited mineral insulating oil of the invention generally comprises an amount of antioxidant agent based on the total weight of the mineral insulating oil generally in a range of from about 0.01 weight percent to about 0.4 weight percent, preferably in a range of from about 0.07 weight percent to about 0.30 weight percent.

A mineral insulating oil of the invention comprising an antioxidant agent, also referred to as an inhibited mineral insulating oil of the invention, generally comprises any amount of antioxidant agent that suitably provides for a mineral insulating oil of the invention. A mineral insulating oil of the invention generally comprises an antioxidant agent in any amount that suitably provides for a mineral insulating oil of the invention. A mineral insulating oil of the invention comprises an amount of an antioxidant agent based on the total weight of the mineral insulating oil generally in a range of from about 0.01 weight percent to about 0.30 weight percent, preferably in a range of from about 0.01 weight percent to about 0.08 weight percent, more preferably in a range of from about 0.01 weight percent to about 0.05 weight percent, and even more preferably in a range of from about 0.01 weight percent to about 0.04 weight percent.

Examples of a suitable antioxidant agent for use in a mineral insulating oil of the invention generally include, but are not limited to, hindered phenols, cinnamate type phenolic esters, alkylated diphenylamines, and combinations thereof. Examples of a preferred antioxidant agent suitable for use in a mineral insulating oil of the invention include, but are not limited to, 2,6-ditertiary-butyl para-cresol, 2,6-ditertiary butylphenol, and combinations thereof. Another preferred antioxidant agent is a combination of 2,6-ditertiary-butyl para-cresol and 2,6-ditertiary butylphenol. A more preferred antioxidant agent is 2,6-ditertiary butylphenol.

When a pour point depressant is present, a mineral insulating oil of the invention generally comprises a pour point depressant in any amount that suitably provides for a mineral insulating oil of the invention. When a pour point depressant is present, a mineral insulating oil of the invention comprises an amount of pour point depressant based on the total weight of the mineral insulating oil generally in a range of from about 0.01 weight percent to about 2 weight percent, preferably in a range of from about 0.01 weight percent to about 1 weight percent, more preferably in a range of from about 0.01 weight percent to about 0.5 weight percent, and even more preferably in a range of from about 0.01 weight percent to about 0.2 weight percent.

When an anti-gassing agent is present, a mineral insulating oil of the invention generally comprises an anti-gassing agent in any amount that suitably provides for a mineral insulating oil of the invention. When an anti-gassing agent is present, a mineral insulating oil of the invention comprises an amount of anti-gassing agent based on the total weight of the mineral insulating oil generally in a range of from about 0.01 weight percent to about 5 weight percent, preferably in a range of from about 0.01 weight percent to about 3 weight percent, and more preferably in a range of from about 0.01 weight percent to about 2 weight percent.

The feedstock compositions for a process of the invention may be hydrotreated lubricant base oil compositions produced at lubricant refineries. One advantage of a process of the invention is that no post blending processes, for example, but not limited to, clay filtering, dewaxing, deasphalting, hydrotreating, solvent extraction, and combinations thereof are required to produce a mineral insulating oil of the invention. Although not required, if desired, a post-blending process or "finishing step", for example, but not limited to, clay filtering, dewaxing, deasphalting, hydrotreating, solvent extraction, and combinations thereof, may be performed.

In certain embodiments of the invention, no additional post-blending processes are performed. The lack of post-blending processes provides for a process of the invention that is cost effective, since a process of the invention does not require any additional costs for performing such post-blending processes.

An advantage of the invention is that no specialized processing equipment is required. The main equipment requirements comprise a contacting apparatus, for example, but not limited to, a blending apparatus. Therefore, not only is the initial capital investment required minimal, the invention is not limited to being performed within a refinery, but may also be performed at any suitable location, for example, the location where a mineral insulating oil of the invention is to be used, a separate process facility, or while in transit between locations.

A naphthenic base oil and a paraffinic base oil used in a process of the invention may be any naphthenic base oil and paraffinic base oil that suitably provides for a mineral insulating oil of the invention. A naphthenic base oil and a paraffinic base oil used in a process of the invention are generally nitrogen-free and sulfur-free and are generally obtained by treating a naphthenic distillate or a paraffinic distillate boiling in the mineral insulating oil range, for example in a range of from about 225° C. to about 480° C. at atmospheric pressure. Naphthenic base oils are generally differentiated from paraffinic base oils by having a greater percentage of naphthenic (cycloalkane) saturated structures compared to paraffinic saturated structures.

A naphthenic base oil used in a process of the invention generally comprises less than about 50 parts per million (ppm) nitrogen, preferably less than about 25 ppm nitrogen. A naphthenic base oil used in a process of the invention comprises nitrogen generally in a range of from about 0.5 ppm nitrogen to about 50 ppm nitrogen, preferably in a range of from about 1 ppm nitrogen to about 25 ppm nitrogen.

A naphthenic base oil used in a process of the invention generally comprises less than about 500 ppm sulfur, preferably less than about 250 ppm sulfur. A naphthenic base oil used in a process of the invention comprises sulfur generally in a range of from about 5 ppm sulfur to about 500 ppm sulfur, preferably in a range of from about 10 ppm sulfur to about 250 ppm sulfur.

A naphthenic base oil used in a process of the invention generally comprises less than about 40 weight percent sulfide sulfur, preferably less than about 30 weight percent sulfide sulfur, and more preferably less than about 20 weight percent sulfide sulfur, based on the total weight of the naphthenic base oil.

A naphthenic base oil used in a process of the invention generally comprises a ratio of total sulfur to basic nitrogen of less than about 80:1, preferably less than about 60:1, more preferably less than about 40:1, and even more preferably less than about 30:1.

A naphthenic base oil used in a process of the invention may be prepared generally by distilling a crude oil feedstock to provide for a naphthenic distillate that may then be subjected to hydrotreating.

A paraffinic base oil used in a process of the invention generally comprises less than about 100 parts per million (ppm) nitrogen, preferably less than about 50 ppm nitrogen, and more preferably less than about 25 ppm nitrogen. A paraffinic base oil used in a process of the invention comprises nitrogen generally in a range of from about 0.5 ppm nitrogen to about 100 ppm nitrogen, preferably in a range of from about 1 ppm nitrogen to about 50 ppm nitrogen, and more preferably in a range of from about 1 ppm nitrogen to about 25 ppm nitrogen.

A paraffinic base oil used in a process of the invention generally comprises less than about 4000 ppm sulfur, preferably less than about 3000 ppm sulfur, and more preferably less than about 2000 ppm sulfur. A paraffinic base oil used in a process of the invention comprises sulfur generally in a range of from about 100 ppm sulfur to about 4000 ppm sulfur, preferably in a range of from about 100 ppm sulfur to about 3000 ppm sulfur, and more preferably in a range of from about 500 ppm sulfur to about 2000 ppm sulfur.

A paraffinic base oil used in a process of the invention generally comprises greater than about 0.01 weight percent sulfide sulfur, preferably greater than about 0.03 weight percent sulfide sulfur, and more preferably greater than about 0.04 weight percent sulfide sulfur, based on the total weight of the paraffinic base oil.

A paraffinic base oil used in a process of the invention generally comprises a ratio of total sulfur to basic nitrogen of less than about 80:1, preferably less than about 60:1, more preferably less than about 50:1, and even more preferably less than about 40:1.

A paraffinic base oil used in a process of the invention generally comprises a ratio of sulfide sulfur to basic nitrogen of greater than about 5:1, preferably greater than about 15:1, and more preferably greater than about 20:1.

A paraffinic base oil used in a process of the invention may be prepared generally by distilling a crude oil feedstock to provide for a paraffinic distillate that may then be subjected to hydrofining. Hydrofining refers to treating by, for example, but not limited to, solvent extraction, hydrotreating, dewaxing, and combinations thereof. Generally, hydrofining of a paraffinic distillate reduces the amounts of nitrogen and sulfur to levels as disclosed herein, but retains a level of sulfide sulfur for oxidation inhibition.

A paraffinic base oil used in a process of the invention generally comprises sulfide sulfur in an amount that may provide for oxidation inhibition and may limit the amount of basic nitrogen and polyaromatics (three or more aromatic ring hydrocarbons) in a mineral insulating oil of the invention. A paraffinic base oil used in a process of the invention comprises sulfide sulfur generally in a range of from about 100 ppm sulfide sulfur to about 1200 ppm sulfide sulfur, preferably in a range of from about 250 ppm sulfide sulfur to about 1000 ppm sulfide sulfur. The amount of basic nitrogen is generally less than about 100 ppm basic nitrogen and is generally in a range of from about 1 ppm basic nitrogen to about 50 ppm basic nitrogen. The amount of polyaromatics is generally less than about 2 weight percent and preferably in a range of from about 0.1 weight percent to about 1.0 weight percent based on the total weight of the paraffinic base oil.

The amount of sulfide sulfur that may be present in an inhibited mineral insulating oil of the invention may help provide for oxidation inhibition and the inhibited mineral insulating oil may exhibit excellent oxidation stability.

Generally, naphthenic base oils and paraffinic base oils are produced as a product fraction in the production of lubricant base oils and are readily available. Generally, a naphthenic base oil suitable for use in a process of the invention comprises an aniline point of at most about 110° C. American Standard Test Method (ASTM) D611 (incorporated herein by reference), preferably at most about 100° C., more preferably at most about 95° C., and even more preferably at most about 85° C. Generally, a naphthenic base oil suitable for use in a process of the invention comprises a flash point of at least about 135° C. (ASTM D92) (incorporated herein by reference). Preferably, a naphthenic base oil comprises a flash point of at least about 145° C. (ASTM D92).

A viscosity of a naphthenic base oil used in a process of the invention is generally less than the paraffinic base oil with which it is to be contacted, preferably blended. A naphthenic base oil comprises a viscosity of at least about 7 $mm^2s^{-1}$ at 40° C. (ASTM D445) (incorporated herein by reference) and no greater than about 12 $mm^2s^{-1}$ at 40° C. (ASTM D445). A naphthenic base oil of the invention comprises a viscosity generally in a range of from about 7 $mm^2s^{-1}$ to about 12 $mm^2s^{-1}$ at 40° C. (ASTM D445). A naphthenic base oil of the invention comprises a viscosity preferably in a range of from about 7 $mm^2s^{-1}$ to about 11 $mm^2s^{-1}$ at 40° C. (ASTM D445).

Generally, a naphthenic base oil used in a process of the invention comprises an aniline point of at most about 110° C. (ASTM D611), a flash point of at least about 135° C. (ASTM D92), and a viscosity of at least about 7 $mm^2s^{-1}$ at 40° C. (ASTM D445). Generally, a naphthenic base oil suitable for use in a process of the invention comprises a viscosity index (ASTM D2270) of less than about 70.

A paraffinic base oil suitable for use in a process of the invention comprises a relatively high aniline point, generally less than about 115° C. (ASTM D611). Generally, a paraffinic base oil suitable for use in a process of the invention comprises an aniline point of at most about 105° C., preferably at most about 100° C. (ASTM D611).

A paraffinic base oil suitable for use in a process of the invention comprises a flash point of at least about 135° C. (ASTM D92). Preferably, a paraffinic base oil comprises a flash point of at least about 145° C. (ASTM D92).

A paraffinic base oil suitable for use in a process of the invention comprises a viscosity of at least about 10.0 $mm^2s^{-1}$) at 40° C., preferably at least about 11.5 $mm^2s^{-1}$ at 40° C. (ASTM D445). Preferably, a paraffinic base oil should also comprise a viscosity of at least about 2.5 $mm^2s^{-1}$ at 100° C. (ASTM D445).

Generally, a paraffinic base oil used in a process of the invention comprises an aniline point of at most about 105° C. (ASTM D611), a flash point of at least about 135° C. (ASTM D92), and a viscosity of at least about 10.0 $mm^2s^{-1}$ at 40° C. (ASTM D445). Generally, a paraffinic base oil suitable for use in a process of the invention comprises a viscosity index (ASTM D2270) of greater than about 70.

Generally any crude oil may be used as the source of feedstock to be distilled to provide for a naphthenic distillate, a paraffinic distillate, and combinations thereof. Examples of a suitable crude include, but are not limited to, Arabian Light, Arabian Medium, Arabian Heavy, Orient, Kuwati, Isthmus, Maya, Oman, Brent, and combinations thereof.

Processing of a crude oil feed to provide for a naphthenic base oil or a paraffinic base oil may comprise subjecting the crude oil feed (naphthenic or paraffinic) to distillation, solvent extraction, dewaxing, and hydrotreatment.

The distilled product from the crude feed may be solvent extracted to remove polyaromatic molecules using, for example, but not limited to, furfuryl, phenol, n-methylpyrrolidine, and combinations thereof. Generally, solvent extraction is an optional step used for the naphthenic distillate. The solvent extracted distillate may be hydrofined (also referred to in the art as hydrotreated) using hydrogenation and dewaxing conditions. Generally, the naphthenic distillate may not be subjected to dewaxing. The conditions generally comprise contacting the solvent extracted distillate with a catalyst at hydrotreating conditions comprising: a temperature; a pressure, and a hydrogen flow rate effective to increase the naphthenic and/or paraffinic contents.

Hydrotreating may comprise contacting the solvent-extracted distillate with a hydrotreating catalyst under hydrotreating conditions. Suitable hydrotreating conditions may comprise: a temperature in a range of from about 190° C. to about 400° C.; a pressure greater than atmospheric, generally about 3000 kilopascals (kPa) or more; and a hydrogen circulation rate in a range of from about 70 to about 2700 $m^3$ hydrogen/$m^3$ liquid feed.

Examples of suitable hydrotreating metal(s) include, but are not limited to, cobalt, chromium, molybdenum, tungsten, magnesium, rhenium, iron, ruthenium, iridium, nickel, palladium, platinum, and combinations thereof. Examples of preferred hydrotreating metals include, but are not limited to, nickel, palladium, platinum, and combinations thereof.

The hydrotreating metal generally is on a suitable support which has sufficient surface area and does not interfere with the hydrotreating process. Examples of suitable hydrotreating catalyst supports include, but are not limited to, metal oxides and molecular sieves. Examples of preferred hydrotreating catalyst supports may comprise dispersed zeolite effective to increase saturation of remaining aromatic molecules.

The resulting hydrotreated product boils at a temperature in a range of from about 38° C. to about 538° C. The hydrotreated product is subjected to separation conditions effective to separate a naphthenic base oil or a paraffinic base oil, preferably boiling in the mineral insulating oil range, for example, a temperature in a range of from about 225° C. to about 480° C. Any suitable separation conditions may be used as long as they are effective to separate a naphthenic base oil or a paraffinic base oil boiling at a temperature in a range of from about 225° C. to about 480° C.

The aniline point of a mineral insulating oil may be used to indicate the level of solvency with rubber compounds, in particular a low aniline point (less than 110° C. according to ASTM D611) is indicative of high solvency for rubber compounds. The aniline point of a mineral insulating oil of the invention may be generally in a range useful for mineral insulating oil applications known to those skilled in the art. Generally, the aniline point of a mineral insulating oil of the invention is in a range of from about 60° C. to about 100° C. (ASTM D611). Preferably, the aniline point of a mineral insulating oil of the invention is in a range of from about 70° C. to about 100° C. (ASTM D611).

The viscosity of a mineral insulating oil of the invention is generally in a range useful for mineral insulating oil applications known to those skilled in the art. Generally, the viscosity of a mineral insulating oil of the invention is in a range of from about 6 $mm^2s^{-1}$ to about 12 $mm^2s^{-1}$ at 40° C. according to ASTM D445. Preferably, the viscosity of a mineral insulating oil of the invention is in a range of from about 7 $mm^2s^{-1}$ to about 11 $mm^2s^{-1}$ at 40° C. according to ASTM D445.

The flash point of a mineral insulating oil of the invention should be kept reasonably high. Preferably, a mineral insulating oil of the invention should have a flash point of at least about 135° C. (Pensky Martin Closed Cup, ASTM D93) (incorporated herein by reference). The flash point of a mineral insulating oil of the invention is generally in a range of from about 135° C. to about 160° C., preferably in a range of from about 145° C. to about 160° C. (ASTM D93).

The pour point of a mineral insulating oil of the invention is generally in a range useful for mineral insulating oil applications known to those skilled in the art. Generally, the pour point of a mineral insulating oil of the invention is at most about minus 40 degrees Celsius (−40° C.) or lower according to ASTM D5950 (incorporated herein by reference).

The specific gravity of a mineral insulating oil of the invention is generally in a range useful for mineral insulating oil applications known to those skilled in the art. Generally, the specific gravity of a mineral insulating oil of the invention is in a range of from about 0.85 to about 0.89 at 15.56° C. according to ASTM D4052 (incorporated herein by reference).

A mineral insulating oil of the invention may comprise an aniline point in a range of from about 60° C. to about 100° C. (ASTM D611), a viscosity in a range of from about 6 $mm^2s^{-1}$ to about 12 $mm^2s^{-1}$ at 40° C. (ASTM D445), a flash point in a range of from about 135° C. to about 160° C. (ASTM D92) and a pour point of about −40° C. or lower (ASTM D5950).

A mineral insulating oil of the invention generally comprises less than about 50 parts per million (ppm) nitrogen, preferably less than about 35 ppm nitrogen, and more preferably less than about 30 ppm nitrogen. A mineral insulating oil of the invention generally comprises nitrogen generally in a range of from about 2 ppm nitrogen to about 50 ppm nitrogen, preferably in a range of from about 2 ppm nitrogen to about 35 ppm nitrogen, and more preferably in a range of from about 2 ppm nitrogen to about 30 ppm nitrogen.

A mineral insulating oil of the invention generally comprises less than about 500 ppm sulfur, preferably less than about 400 ppm sulfur, and more preferably less than about 300 ppm sulfur. A mineral insulating oil of the invention comprises sulfur generally in a range of from about 100 ppm sulfur to about 500 ppm sulfur, preferably in a range of from about 100 ppm sulfur to about 400 ppm sulfur, and more preferably in a range of from about 100 ppm sulfur to about 300 ppm sulfur.

A mineral insulating oil of the invention generally comprises greater than about 0.004 weight percent sulfide sulfur, preferably greater than about 0.006 weight percent sulfide sulfur, and more preferably greater than about 0.010 weight percent sulfide sulfur, based on the total weight of the mineral insulating oil.

A mineral insulating oil of the invention generally comprises a ratio of total sulfur to basic nitrogen of less than about 70:1, preferably less than about 60:1, more preferably less than about 50:1, and even more preferably less than about 40:1.

A mineral insulating oil of the invention comprises a ratio of sulfide sulfur to basic nitrogen of generally greater than about 5:1, preferably greater than about 10:1, and generally less than about 50:1, preferably less than about 40:1, more preferably less than about 35:1, and even more preferably less than about 30:1.

A mineral insulating oil of the invention comprises an amount of polyaromatics (three or more ring species) of generally less than about 0.5 weight percent, preferably less than about 0.4 weight percent, and more preferably less than about 0.3 weight percent, based on the total weight of the mineral insulating oil.

The gassing tendency of a mineral insulating oil of the invention may be reduced by adding one or more anti-gassing agent(s). If a mineral insulating oil of the invention does not comprise an anti-gassing tendency of about 30 microliters per minute (μL/min) or less, then an anti-gassing agent may reduce the gassing tendency of a mineral insulating oil of the invention to about 30 μL/min or less, preferably about 15 μL/min or less, and more preferably about 5 μL/min or less according to ASTM D2300 (incorporated herein by reference).

An antigassing agent generally comprises an antigassing aromatic that comprises at least one labile hydrogen atom. Examples of a suitable antigassing agent include, but are not limited to, monoaromatic ring species, diaromatic ring species, and combinations thereof. Examples of a suitable antigassing agent include, but are not limited to, antigassing agents having from about 9 to about 11 carbon atoms selected from the group consisting of alkyl-substituted aromatic compounds, alkyl substituted aromatic compounds, partially saturated aromatic compounds, and combinations thereof.

Examples of a suitable anti-gassing agent include, but are not limited to, dihydrophenanthrene, phenyl ortho xylyl ethane, alkylated benzenes, and combinations thereof. Examples of suitable alkylated benzenes include, but are not limited to, diethylbenzenes, tetrahydro-5-(1-phenylethyl)-naphthalene, acenaphthene, tetrahydro-naphthalene, alkylated tetrahydronaphthalenes, tetrahydroquinoline, and combinations thereof. An anti-gassing agent may comprise about 80 weight percent 1,5-dimethyl naphthalene and about 20 weight percent isomeric dimethyl naphthalenes. Generally, a mineral insulating oil of the invention may comprise an antigassing agent in an amount based on the total weight of a mineral insulating oil of the invention in a range of from about 0.01 weight percent to about 5 weight percent, preferably in a range of from about 0.1 weight percent to about 2 weight percent, and more preferably in a range of from about 0.1 weight percent to about 1 weight percent.

When subjected to an oxidation stability test (IEC 61125C) (incorporated herein by reference), an uninhibited mineral insulating oil of the invention may produce a weight percent sludge (IEC 61125C) at 164 hours based on the total weight of the mineral insulating oil of generally about 0.8 weight percent or less, preferably about 0.6 weight percent or less, more preferably about 0.4 weight percent or less, and even more preferably about 0.3 weight percent or less. An uninhibited mineral insulating oil of the invention may produce a weight percent sludge (IEC 61125C) at 164 hours based on the total weight of the mineral insulating oil generally in a range of from about 0.01 weight percent to about 0.8 weight percent, preferably in a range of from about 0.01 weight percent to about 0.6 weight percent, more preferably in a range of from about 0.01 weight percent to about 0.4 weight percent, and even more preferably in a range of from about 0.01 weight percent to about 0.3 weight percent.

When subjected to an oxidation test (IEC 61125C), an uninhibited mineral insulating oil of the invention may produce a "total acid number" (TAN) at 164 hours of generally about 1.2 milligrams (mg) of potassium hydroxide (KOH) per gram of mineral insulating oil (mg of KOH/g) or less, preferably about 1.1 mg of KOH/g or less, more preferably about 1.0 mg of KOH/g or less, and even more preferably about 0.9 mg of KOH/g or less. When subjected to an oxidation test (IEC 61125C), an uninhibited mineral insulating oil of the invention may produce a "total acid number" (TAN) at 164 hours generally in a range of from about 0.01 mg of KOH/g to about 1.2 mg of KOH/g, preferably in a range of from about 0.01 mg of KOH/g to about 1.1 mg of KOH/g, more preferably in a range of from about 0.01 mg of KOH/g to about 1.0 mg of KOH/g, and even more preferably in a range of from about 0.01 mg of KOH/g to about 0.9 mg of KOH/g.

An uninhibited mineral insulating oil of the invention generally may produce a weight percent sludge (ASTM D2440) (incorporated herein by reference) based on the total weight of the uninhibited mineral insulating oil of about 0.4 weight percent or less and a TAN of about 1.0 mg of KOH/g or less. An uninhibited mineral insulating oil of the invention preferably may produce a weight percent sludge based on the total weight of the uninhibited mineral insulating oil of about 0.3 weight percent or less and a TAN of about 0.7 mg of KOH/g or less. An uninhibited mineral insulating oil of the invention more preferably may produce a weight percent sludge based on the total weight of the uninhibited mineral insulating oil of about 0.3 weight percent or less and a TAN of about 0.5 mg of KOH/g or less.

When subjected to an oxidation stability test (IEC 61125C) (incorporated herein by reference), a mineral insulating oil of the invention may produce a weight percent sludge (IEC 61125C) at 164 hours based on the total weight of the mineral insulating oil of generally about 0.8 weight percent or less, preferably about 0.6 weight percent or less, more preferably about 0.4 weight percent or less, and even more preferably about 0.3 weight percent or less. A mineral insulating oil of the invention may produce a weight percent sludge (IEC 61125C) at 164 hours based on the total weight of the mineral insulating oil generally in a range of from about 0.01 weight percent to about 0.8 weight percent, preferably in a range of from about 0.01 weight percent to about 0.6 weight percent, more preferably in a range of from about 0.01 weight percent to about 0.4 weight percent, and even more preferably in a range of from about 0.01 weight percent to about 0.3 weight percent.

When subjected to an oxidation test (IEC 61125C), a mineral insulating oil of the invention may produce a "total acid number" (TAN) at 164 hours of generally about 1.2 milligrams (mg) of potassium hydroxide (KOH) per gram of mineral insulating oil (mg of KOH/g) or less, preferably about 1.1 mg of KOH/g or less, more preferably about 1.0 mg of KOH/g or less, and even more preferably about 0.9 mg of KOH/g or less. When subjected to an oxidation test (IEC 61125C), a mineral insulating oil of the invention may produce a "total acid number" (TAN) at 164 hours generally in a range of from about 0.01 mg of KOH/g to about 1.2 mg of KOH/g, preferably in a range of from about 0.01 mg of KOH/g to about 1.1 mg of KOH/g, more preferably in a range of from about 0.01 mg of KOH/g to about 1.0 mg of KOH/g, and even more preferably in a range of from about 0.01 mg of KOH/g to about 0.9 mg of KOH/g.

A mineral insulating oil of the invention generally may produce a weight percent sludge (ASTM D2440) (incorporated herein by reference) based on the total weight of the mineral insulating oil of about 0.3 weight percent or less and a TAN of about 0.6 mg of KOH/g or less. A mineral insulating oil of the invention preferably may produce a weight percent sludge based on the total weight of the mineral insulating oil of about 0.25 weight percent or less and a TAN of about 0.5 mg of KOH/g or less. A mineral insulating oil of the invention more preferably may produce a weight percent sludge based on the total weight of the mineral insulating oil of about 0.2 weight percent or less and a TAN of about 0.4 mg of KOH/g or less.

A mineral insulating oil of the invention may generally pass the oxidation stability by rotating bomb test (ASTM D2112) (incorporated herein by reference) exceeding greater than 195 minutes.

If desired, a pour point depressant may be added to a paraffinic base oil, naphthenic base oil, and combinations thereof, to depress the pour point of a mineral insulating oil of the invention to about minus 40 degrees Celsius (−40° C.) or less, preferably to about minus 42 degrees Celsius (−42° C.) or less. A variety of pour point depressants may be used. Examples of a suitable pour depressant include, but are not limited to, pour point depressants based on polymethacrylate chemicals.

When a pour point depressant is present, a mineral insulating oil of the invention comprises an amount of pour point depressant based on the total weight of the mineral insulating oil generally in a range of from about 0.01 weight percent to about 1.0 weight percent, preferably in a range of from about 0.01 weight percent to about 0.5 weight percent, more preferably in a range of from about 0.01 weight percent to about 0.3 weight percent, even more preferably in a range of from about 0.01 weight percent to about 0.2 weight percent, and yet even more preferably in a range of from about 0.01 weight percent to about 0.1 weight percent.

A mineral insulating oil of the invention may be used as, for example, but not limited to, an electrical oil, a transformer oil, a dielectric fluid, and combinations thereof. A mineral insulating oil of the invention may meet specifications required for a variety of applications including, but not limited to, electrical oils, transformer oils, dielectric fluids, and combinations thereof. A preferred use for a mineral insulating oil of the invention comprises use as a transformer oil(s).

In addition to oxidation resistance and low gassing tendency, a mineral insulating oil of the invention may generally comprise a number of other properties including, but not limited to, electrical resistance and thermal stability. A mineral insulating oil of the invention may meet relevant specifications for physical, electrical, and chemical properties for electrical oils provided by, for example, but not limited to, ASTM D3487 (Type I and Type II) (incorporated herein by reference) and British Standard BS 148 (incorporated herein by reference).

A mineral insulating oil of the invention may meet the ASTM physical property requirements for electrical oils including, but not limited to: a color of about 0.5 or less, as measured using ASTM D1500 (incorporated herein by reference); a flash point of about 145° C. or greater, as measured using ASTM D92 (incorporated herein by reference); an interfacial tension of about 40 dynes/cm or more at 25° C., as measured using ASTM D971 (incorporated herein by reference); a pour point of about −40° C. or less, as measured using ASTM D5950 (incorporated herein by reference); a relative density of 0.895 grams/milliliter or less at 20° C., as measured using ASTM D4052 (incorporated herein by reference); and, a viscosity of about 1800 $mm^2s^{-1}$ or less at −30° C., about 12.0 $mm^2s^{-1}$ or less at 40° C., and about 3.0 $mm^2s^{-1}$ or less at 100° C., as measured using ASTM D445 (incorporated herein by reference).

A mineral insulating oil of the invention may also meet the electrical property requirements for electrical oils including, but not limited to, the ASTM requirements of a dielectric breakdown voltage of 30 kV or more at 60 Hz by disc electrodes as measured using ASTM D877 (incorporated herein by reference).

A mineral insulating oil of the invention may also meet the chemical property requirements for electrical oils including, but not limited to, the ASTM requirements of: an oxidation inhibitor content for Type I oils of 0.08 weight percent or less, and for Type II oils of 0.3 weight percent or less, as measured using ASTM D2668 (incorporated herein by reference), or, where the oxidation inhibitor is 2,6-ditertiary butyl cresol, as measured using ASTM D1473 (incorporated herein by reference); a low content of elemental sulfur and thermally unstable sulfur-bearing compounds to prevent corrosion of certain metals, for example, but not limited to, copper and silver, in contact with the mineral insulating oil, as measured using ASTM D1274 (incorporated herein by reference); 35 ppm or less water as measured using ASTM D1533 (incorporated herein by reference); a neutralization number of 0.03 mg KOH/g or less as measured using ASTM D974 (incorporated herein by reference); and, a non-detectible polychlorinated biphenyl (PCB) content, or a content of less than 1 ppm, as measured using ASTM D4059 (incorporated herein by reference).

A mineral insulating oil of the invention may also meet the chemical property requirements for electrical oils including, but not limited to, the IEC 60296 (incorporated herein by reference) uninhibited oil limits comprising: an antioxidant additive content of not detectable, a low content of elemental sulfur and thermally unstable sulfur-bearing compounds to prevent corrosion of certain metals, for example, but not limited to, copper and silver, in contact with the mineral insulating oil, as measured using DIN 51353 (incorporated herein by reference); 30 ppm or less water, as measured using IEC 60814 (incorporated herein by reference); a neutralization number of 0.01 mg KOH/g or less, as measured using IEC 62021-1 (incorporated herein by reference); a non-detectible polychlorinated biphenyl (PCB) content, as measured using IEC 61619 (incorporated herein by reference); a breakdown voltage of 30 kV, as measured using IEC 60156 (incorporated herein by reference); a Dielectric Dissipation Factor (DDF) at 90° C. of 0.005, as measured using IEC 60247 (incorporated herein by reference); and, although not a requirement, an interfacial tension of about 40 dynes/cm or more at 25° C., as measured using ISO 6295 (incorporated herein by reference).

EXAMPLES

The hydrofined naphthenic distillates (naphthenic base oils) used in the Examples are referenced Naph 1 and Naph 2. Naph 1 was a commercially available naphthenic base oil from Ergon Refining, Inc., Vicksburg, Miss. having a designation "Hygold 60" manufactured using a naphthenic crude feedstock. Naph 2 was a commercially available naphthenic base oil from Ergon Refining, Inc., Vicksburg, Miss. having a designation "Hygold 60" manufactured using a different naphthenic crude feedstock compared to that used to manufacture Naph 1. Naph 1 and Naph 2 are characterized in Table 1. The naphthenic base oils Naph 1 and Naph 2 had very low nitrogen and sulfur content. Naph 1 and Naph 2 tested at very high sludge and TAN values that exceeded IEC 61125C requirements for oxidation stability of uninhibited oils. In Table 1, "nm" indicates not measured, "IBP" indicates initial boiling point, and "FBP" indicates final boiling point. "IEC" as referred to herein indicates International Electrotechnical Commission. Test Methods disclosed in Tables 1 through 4 are incorporated herein by reference.

TABLE 1

| Property | Test Method | Units | Naph 1 | Naph 2 |
|---|---|---|---|---|
| Kinetic Viscosity at 40° C. | ASTM D445 | $mm^2s^{-1}$ | 9.23 | 8.75 |
| Kinetic Viscosity at 100° C. | ASTM D445 | $mm^2s^{-1}$ | 2.30 | 2.24 |
| Viscosity Index | ASTM D2270 | | 36 | 44 |
| Kinetic Viscosity at −30° C. | ASTM D445 | $mm^2s^{-1}$ | nm | 680 |
| Density at 15.6° C. | ASTM D4052 | g/ml | 0.8891 | 0.8844 |
| Refractive Index at 20° C. | ASTM D1218 | | 1.4856 | 1.4821 |
| Flash Point, Cleveland Open Cup | ASTM D92 | ° C. | 152 | 154 |
| Total Sulfur | ASTM D5453 | ppm | 60 | 30 |
| Sulfide Sulfur | TMS368/84 | wt % | <20 | <20 |
| Total Nitrogen | ASTM D4629 | ppm | 2 | 2 |
| Basic Nitrogen | ASTM D2896 | ppm | 2 | 1 |
| Total Sulfur:Basic Nitrogen | | | 30:1 | 30:1 |
| Sulfide Sulfur:Basic Nitrogen | | | <10:1 | <20:1 |
| ASTM Color | ASTM D1500 | | L0.5 | L0.5 |
| Pour Point | ASTM D5950 | ° C. | −60 | −60 |
| Aniline Cloud Point | ASTM D611 | ° C. | 73 | 75 |
| Compound Distribution | ASTM D2549 | wt % | | |
| Saturates | | | 90.9 | 82.2 |
| Aromatics | | | 8.9 | 17.5 |
| Polars | | | 0.2 | 0.3 |
| Polyaromatics | LS/3080 | wt % | 0.08 | 0.11 |
| Oxidation Stability | IEC 61125C | | | |
| Sludge, 164 Hours | | wt % | 2.7 | 2.8 |
| TAN, 164 Hours | | mgKOH/g | 3.6 | 5.4 |
| Dielectric Dissipation Factor at 90° C. | IEC 60274 | | 0.46 | 0.63 |
| Gassing Tendency | ASTM D2300 | μL/min | 18.2 | 24.3 |
| Simulated Distillation | ASTM D6417 | IBP, ° C. | 228.6 | 227.9 |
| | | 5% | 258.3 | 258.3 |
| | | 10% | 270.4 | 269.6 |
| | | 20% | 286.4 | 284.1 |
| | | 30% | 297.4 | 294.7 |
| | | 40% | 306.5 | 303.9 |
| | | 50% | 314.8 | 312.3 |
| | | 60% | 324.9 | 322.3 |
| | | 70% | 336.9 | 334.6 |
| | | 80% | 351.3 | 349.7 |
| | | 90% | 370.8 | 370.2 |
| | | 95% | 387.2 | 388.8 |
| | | FBP | 441.6 | 650.3 |

The hydrofined paraffinic distillates (paraffinic base oils) in the Examples are referenced Para 1, Para 2, and Para 3. Para 1 was a commercially available paraffinic base oil from PetroChina, Dalian, China having a designation "Dalian SN 70". Para 2 was a commercially available paraffinic base oil from Sunoco Company, Tulsa, Okla., having a designation "Sunoco SN 70". Para 3 was a commercially available paraffinic base oil from Sunoco Company, Tulsa, Okla., having a designation "Sunoco CN 70". Para 1, Para 2, and Para 3 are characterized in Table 2. Para 1, Para 2, and Para 3 had high pour point values, moderate amounts of nitrogen and sulfur, and moderate amounts of sulfide sulfur. Para 2 was tested using the IEC 61125C limits and demonstrated acceptable oxidation stability performance. In Table 2, "nm" indicates not measured, "IBP" indicates initial boiling point, and "FBP" indicates final boiling point.

TABLE 2

| Property | Test Method | Units | Para 1 | Para 2 | Para 3 |
|---|---|---|---|---|---|
| Kinetic Viscosity at 40° C. | ASTM D445 | $mm^2s^{-1}$ | 14.09 | 11.38 | 11.64 |
| Kinetic Viscosity at 100° C. | ASTM D445 | $mm^2s^{-1}$ | 3.29 | 2.81 | 2.79 |
| Viscosity Index | ASTM D2270 | | 101 | 85 | 71 |
| Density at 15.6° C. | ASTM D4052 | g/ml | 0.8555 | 0.8504 | 0.8649 |
| Refractive Index at 20° C. | | | 1.4719 | 1.4683 | 1.4771 |
| Flash Point, Cleveland Open Cup | ASTM D92 | ° C. | nm | 183 | 174 |

TABLE 2-continued

| Property | Test Method | Units | Para 1 | Para 2 | Para 3 |
|---|---|---|---|---|---|
| Total Sulfur | ASTM D5453 | ppm | 715 | 872 | 1950 |
| Sulfide Sulfur | TMS368/84 | wt % | 0.04 | 0.06 | nm |
| Total Nitrogen | ASTM D4629 | ppm | 22 | 20 | 98 |
| Basic Nitrogen | ASTM D2896 | ppm | 21 | 19 | 83 |
| Total Sulfur:Basic Nitrogen | | | 34:1 | 46:1 | 23:1 |
| Sulfide Sulfur:Basic Nitrogen | | | 19:1 | 32:1 | nm |
| Pour Point | ASTM D5950 | ° C. | −9 | −15 | −15 |
| Cloud Point | ASTM D5771 | ° C. | nm | −10.3 | nm |
| Aniline Cloud Point | ASTM D611 | ° C. | 96.2 | 94 | 85 |
| Compound Distribution | ASTM D2549 | wt % | | | |
| Saturates | | | 86.6 | 88.4 | 80.0 |
| Aromatics | | | 13.0 | 10.5 | 19.5 |
| Polars | | | 0.4 | 1.1 | 0.5 |
| Polyaromatics | LS/3080 | wt % | 0.27 | 0.12 | nm |
| Oxidation Stability | IEC 61125C | | | | |
| Sludge, 164 Hours | | wt % | nm | 0.4 | nm |
| TAN, 164 Hours | | mgKOH/g | nm | 0.8 | nm |
| Gassing Tendency | ASTM D2300 | μL/min | nm | +26.3 | nm |
| Simulated Distillation | ASTM D6417 | IBP, ° C. | 247.7 | 288.8 | 272.6 |
| | | 5% | 301.2 | 315.7 | 302.3 |
| | | 10% | 322.9 | 327.8 | 313.2 |
| | | 20% | 349.0 | 341.3 | 327.6 |
| | | 30% | 364.8 | 349.9 | 339.2 |
| | | 40% | 376.7 | 356.8 | 348.3 |
| | | 50% | 386.4 | 362.9 | 356.1 |
| | | 60% | 395.2 | 368.7 | 363.6 |
| | | 70% | 403.2 | 374.3 | 371.3 |
| | | 80% | 411.4 | 380.4 | 379.8 |
| | | 90% | 423.4 | 388.4 | 391.7 |
| | | 95% | 435.1 | 395.8 | 402.6 |
| | | FBP | 483.9 | 465.4 | 585.9 |

Examples 1 through 9 disclose various mineral insulating oils provided by contacting a naphthenic base oil and a paraffinic base oil.

In Example 1, 90 grams of Naph 1 was contacted with 10 grams of Para 1. The mixture was stirred mechanically at room temperature (about 25° C.) for about 30 minutes.

In Example 2, 80 grams of Naph 1 was contacted with 20 grams of Para 1 and a 0.1 gram quantity of a pour point depressant commercially available from Degussa-RohMax Oil Additives, Horsham, Pa. having a designation "Viscoplex 1-161". The mixture was stirred mechanically at room temperature (about 25° C.) for about 30 minutes.

In Example 3, 70 grams of Naph 1 was contacted with 30 grams of Para 1 and a 0.3 gram quantity of a pour point depressant commercially available from Degussa-RohMax Oil Additives, Horsham, Pa. having a designation "Viscoplex 1-161". The mixture was stirred mechanically at room temperature (about 25° C.) for about 30 minutes.

In Example 4, 85 grams of Naph 2 was contacted with 15 grams of Para 1. The mixture was stirred mechanically at room temperature (about 25° C.) for about 30 minutes.

In Example 5, 85 grams of Naph 2 was contacted with 15 grams of Para 2. The mixture was stirred mechanically at room temperature (about 25° C.) for about 30 minutes.

In Example 6, 90 grams of Naph 2 was contacted with 10 grams of Para 2. The mixture was stirred mechanically at room temperature (about 25° C.) for about 30 minutes.

In Example 7, 85 grams of Naph 2 was contacted with 15 grams of Para 3. The mixture was stirred mechanically at room temperature (about 25° C.) for about 30 minutes.

In Example 8, 90 grams of Naph 2 was contacted with 10 grams of Para 3. The mixture was stirred mechanically at room temperature (about 25° C.) for about 30 minutes.

In Example 9, 95 grams of Naph 2 was contacted with 5 grams of Para 3. The mixture was stirred mechanically at room temperature (about 25° C.) for about 30 minutes.

The mineral insulating oil produced in Examples 1 to 9 are characterized in Table 3. In Table 3, "nm" indicates not measured.

TABLE 3

| Property | Test Method | Units | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|---|
| Naphthenic Base Oil | | | Naph 1 | Naph 1 | Naph 1 | Naph 2 | Naph 2 | Naph 2 | Naph 2 | Naph 2 | Naph 2 |
| Paraffinic Base Oil | | | Para 1 | Para 1 | Para 1 | Para 1 | Para 2 | Para 2 | Para 3 | Para 3 | Para 3 |

TABLE 3-continued

| Property | Test Method | Units | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|---|
| Ratio (wt % naphthenic:wt % paraffinic) | | | 90:10 | 80:20 | 70:30 | 85:15 | 85:15 | 90:10 | 85:15 | 90:10 | 95:5 |
| Pour Point Depressant | | wt % | 0 | 0.1 | 0.3 | 0 | 0 | 0 | 0 | 0 | 0 |
| Total Sulfur | ASTM D5453 | ppm | 126 | 191 | 256 | 133 | 157 | 114 | 319 | 222 | 126 |
| Total Sulfur:Basic Nitrogen | | | 32:1 | 38:1 | 36:1 | 33:1 | 39:1 | 38:1 | 25:1 | 25:1 | 25:1 |
| Sulfide Sulfur:Basic Nitrogen | | | 10:1 | 16:1 | 17:1 | 15:1 | 22:1 | 20:1 | nm | nm | nm |
| Pour Point | ASTM D5950 | ° C. | −51 | −39 | −48 | −30 | −33 | −40 | −36 | −42 | −57 |
| Total Aromatics | ASTM D2549 | wt % | 9.3 | 10.0 | 10.1 | 16.8 | 16.4 | 16.8 | 17.8 | 17.7 | 17.6 |
| Polyaromatics | LS/3080 | wt % | 0.16 | 0.18 | 0.20 | 0.24 | 0.22 | 0.22 | nm | nm | nm |
| Oxidation Stability | IEC 61125C | | | | | | | | | | |
| Sludge, 164 hours | | wt % | 0.3 | 0.2 | 0.4 | 0.3 | 0.2 | 0.2 | 0.3 | 0.2 | 0.9 |
| TAN, 164 hours | | mgKOH/g | 1.0 | 0.8 | 0.7 | 0.8 | 0.5 | 0.5 | 0.6 | 0.8 | 1.9 |
| Dielectric Dissipation Factor at 90° C. | IEC 61125C | | 0.18 | 0.19 | 0.43 | 0.16 | 0.13 | 0.11 | 0.36 | 0.28 | 0.18 |

The mineral insulating oils described in Table 3 were tested against oxidation stability requirements for uninhibited oils in IEC 61125C (incorporated herein by reference) comprising: maximum total acidity of 1.2 mg KOH/g; maximum sludge of 0.8 weight percent; and maximum dielectric dissipation factor at 90° C. of 0.500. The mineral insulating oil produced in Examples 1 to 8 met the oxidation stability requirements for uninhibited oils of IEC 61125C. Naph 1 (Table 1) and Naph 2 (Table 1) did not meet the oxidation stability requirements for uninhibited oils of IEC 61125C. Naph 1 (Table 1) and Naph 2 (Table 1) also did not meet the oxidation stability requirements of ASTM D2440 for Type I mineral insulating oils. The mineral insulating oil produced in Example 9 contained the most (95%) Naph 2 and also did not meet the oxidation stability requirements for uninhibited oils of IEC 61125C.

The total sulfur content ranged from about 114 to about 319 ppm in the mineral insulating oil produced in Examples 1 to 9. Each mineral insulating oil produced in Examples 1 to 9 exhibited a total sulfur to basic nitrogen ratio of less than about 70:1. For meeting the oxidation requirements of IEC 61125C, the mineral insulating oil should generally have sulfide sulfur to basic nitrogen ratios in excess of about 10:1. For meeting the sludge requirements of IEC 61125C, the mineral insulating oil should generally have a low polyaromatic content (polyaromatic refers to three or more aromatic ring species). The polyaromatic content of the mineral insulating oil produced in Examples 1 to 9 was in a range of from about 0.16 weight percent to about 0.24 weight percent based on the total weight of the mineral insulating oil.

By contacting a naphthenic base oil and a paraffinic base oil, the resulting mineral insulating oil was stabilized to meet the IEC 60296 uninhibited transformer oil requirements (incorporated herein by reference) and the ASTM D3487 Type I mineral insulating oil requirements for oxidation stability (incorporated herein by reference).

Table 4 discloses a Product A comprising a blend of 79.8 weight percent Naph 2 (a commercially available naphthenic base oil from Ergon Refining, Inc., Vicksburg, Miss. having a designation "Hygold 60", previously described herein), 20 weight percent Para 2 (a commercially available paraffinic base oil from Sunoco Company, Tulsa, Okla., having a designation "Sunoco SN 70", previously described herein), and 0.2 weight percent of a pour point depressant (commercially available from Degussa-RohMax Oil Additives, Horsham, Pa. having a designation "Viscoplex 1-161", previously described herein). In Table 4, "PMCC" indicates Pensky Martin Closed Cup, "PAH" indicates Polycyclic Aromatic Hydrocarbons, and "PCB" indicates Polychlorinated Biphenyls.

TABLE 4

| Property | Units | IEC 60296 (IEC 296*) Method | IEC 60296 standard, non-inhibited | Product A |
|---|---|---|---|---|
| 1. Function | | | | |
| Kinetic Viscosity at 40° C. | $mm^2/s$ | ISO 3104 | max. 12 | 9.879 |
| Kinetic Viscosity at −30° C. | $mm^2/s$ | ISO 3104 | max. 1800 | 1104 |
| Pour point | ° C. | ISO 3016 | max. −40 | −54 |
| Water content bulk supply | mg/kg | IEC 60814 | max. 30 | |

TABLE 4-continued

| Property | Units | IEC 60296 (IEC 296*) Method | IEC 60296 standard, non-inhibited | Product A |
|---|---|---|---|---|
| drum delivery | | | max. 40 | 38 |
| Breakdown voltage | kV | IEC 60156 | | |
| as delivered | | | min. 30 | 66 |
| after treatment | | | min. 70 | >90 |
| Dielectric Dissipation Factor at 90° C. | | IEC 60274 | max. 0.005 | 0.0030 |
| 2. Refining/stability | | | | |
| Appearance | | | clear, free of sediment and suspended matter | clear, free of sediment and suspended matter |
| Acidity | mg KOH/g | IEC 62021 | max. 0.01 | <0.01 |
| Interfacial tension at 25° C. | N/cm | | no general requirement** | 31 |
| Corrosive sulfur | | DIN 53353 | not corrosive | not corrosive |
| Antioxidant additives uninhibited oil | | IEC 60666 | not detectable | not detectable |
| Furfural content | mg/kg | IEC 61198 | max. 0.1 | <0.1 |
| 3. Performance | | | | |
| Oxidation Stability | | IEC 1125 C | 164 hour test | |
| Sludge | wt % | | max. 0.8 | 0.34 |
| TAN | mg KOH/g | | max. 1.2 | 1.03 |
| Dielectric Dissipation Factor at 90° C. | | | max. 0.500 | 0.222 |
| 4. Health, safety, and environmental | | | | |
| Flash Point (PMCC) | ° C. | ISO 2719 | min. 135 | 145 |
| Density at 20° C. | $kg/m^3$ | ISO 3675 | max. 895 | 879.9 |
| PAH | % | IP 346 | max. 3 | 1.89 |
| PCB | mg/kg | IEC 61619 | not detectable | not detectable |

*to be dropped when IEC 60296 in force
**where interfacial tension at 25° C. is used as a general requirement, the limit is generally a minimum of 40 N/cm It was discovered that contacting a naphthenic base oil and a paraffinic base oil according to a process of the invention may provide for stabilization of the resulting mineral insulating oil to meet IEC 60296 (incorporated herein by reference) uninhibited transformer oil and ASTM D3487 (incorporated herein by reference) Type I mineral insulating oil requirements for oxidation stability. Product A disclosed in Table 4 met the IEC 60296 requirements.

Table 5 discloses a Product A1 and a Product B that were tested against the ASTM D3487 Type I mineral insulating oil requirements (incorporated herein by reference). Table 5 also discloses an example Product C with estimated numbers of a test against the ASTM D3487 Type II mineral insulating oil requirements (incorporated herein by reference). An actual testing of an example Product C against the ASTM D3487 Type I and Type II mineral insulating oil requirements was not conducted. It is estimated that the data that may be obtained from a testing of an example Product C may be similar to the data obtained from testing Product B having a lower amount of antioxidant agent. Product A1 comprised a blend of 90.0 weight percent Naph 2 (a commercially available naphthenic base oil from Ergon Refining, Inc., Vicksburg, Miss. having a designation "Hygold 60", previously described herein) and 10.0 weight percent Para 2 (a commercially available paraffinic base oil from Sunoco Company, Tulsa, Okla., having a designation "Sunoco SN 70", previously described herein). Product B comprised a blend of 79.725 weight percent Naph 2 (a commercially available naphthenic base oil from Ergon Refining, Inc., Vicksburg, Miss. having a designation "Hygold 60", previously described herein), 20 weight percent Para 2 (a commercially available paraffinic base oil from Sunoco Company, Tulsa, Okla., having a designation "Sunoco SN 70", previously described herein), 0.2 weight percent of a pour point depressant (commercially available from Degussa-RohMax Oil Additives, Horsham, Pa. having a designation "Viscoplex 1-161", previously described herein), and 0.075 weight percent of an antioxidant agent (2,6-ditertiary-butyl phenol commercially available from INSPEC Fine Chemicals, Plano, Tex. having a designation "Ionol CP"). An example Product C may be similar to Product B and comprising about 0.3 weight percent antioxidant agent. An example Product C may comprise a blend of 79.5 weight percent Naph 2 (a commercially available naphthenic base oil from Ergon Refining, Inc., Vicksburg, Miss. having a designation "Hygold 60", previously described herein), 20 weight percent Para 2 (a commercially available paraffinic base oil from Sunoco Company, Tulsa, Okla., having a designation "Sunoco SN 70", previously described herein), 0.2 weight percent of a pour point depressant (commercially available from Degussa-RohMax Oil Additives, Horsham, Pa. having a designation "Viscoplex 1-161", previously described herein), and 0.3 weight percent of an antioxidant agent (2,6-ditertiary-butyl phenol commercially available from INSPEC Fine Chemicals, Plano, Tex. having a designation "Ionol CP"). In Table 5, "max." indicates maximum, "min." indicates minimum, "nm" indicates not measured, "cmnt." indicates comment, "a" in the comment column indicates a failing Sludge for Product A1 and a passing sludge for Product B, "b" in the comment column indicates a failing TAN for Product A1 and passing TAN for Product B, "c" in the comment column indicates that the data for an example Product C is estimated and not actual and that the estimated data for an example Product C may be similar to the data obtained from testing Product B having a lower amount of antioxidant agent, "est." in the comment column indicates estimated, and "PCB" indicates Polychiorinated Biphenyls. The test methods disclosed in Table 5 are ASTM test methods and are incorporated herein by reference.

TABLE 5

| Property | Test Method | Units | ASTM D3487 Type I | ASTM D3487 Type II | Product A1 | Product B | Product C | Cmnt. |
|---|---|---|---|---|---|---|---|---|
| 1. Physical | | | | | | | | |
| Aniline Cloud Point | D611 | ° C. | (63-84) | (63-84) | nm | 77 | 77 | est., c |
| Color | D1500 | | 0.5 max. | 0.5 max. | nm | L0.5 | L0.5 | c |
| Flash point | D92 | ° C. | 145 min. | 145 min. | nm | 145 | 145 | c |
| Interfacial Tension at 25° C. | D971 | dynes/cm | 40 min. | 40 min. | nm | 39 | 39 | c |
| Pour Point | D97 | ° C. | −40 min. | −40 min. | −42 | −54 | −54 | c |
| Specific Gravity at 15.6° C. | D1298 | | 0.91 max. | 0.91 max. | nm | 0.88 | 0.88 | est., c |
| Kinetic Viscosity at 100° C. | D445 | $mm^2/s$ | 3.0 max. | 3.0 max. | 2.29 | 2.39 | 2.39 | c |
| Kinetic Viscosity at 40° C. | D445 | $mm^2/s$ | 12.0 max. | 12.0 max. | 8.96 | 9.88 | 9.88 | c |
| Kinetic Viscosity at 0° C. | D445 | $mm^2/s$ | 76.0 max. | 76.0 max. | nm | 53.9 | 53.9 | c |
| Visual Examination | D1524 | | clear/bright | clear/bright | nm | clear/ bright | clear/ bright | c |
| 2. Electrical | | | | | | | | |
| Dielectric Breakdown Voltage at 60 Hz Disc Electrodes | D877 | kV | 30 min. | 30 min. | nm | 66 | 66 | c |
| Gassing tendency | D2300 | μL/min | +30 max. | +30 max. | nm | +24 | +24 | est., c |
| 3. Chemical | | | | | | | | |
| Oxidation Stability, 72 hours | D2440 | | | | | | | |
| % Sludge | | wt % | 0.15 max. | 0.1 max. | 1.32 | 0.01 | 0.01 | a, c |
| TAN | | mg KOH/g | 0.5 max. | 0.3 max. | 3.25 | 0.025 | 0.025 | b, c |
| Oxidation Stability, 164 hours | D2440 | | | | | | | |
| % Sludge | | wt % | 0.3 max. | 0.2 max. | 1.29 | 0.07 | 0.07 | a, c |
| TAN | | mg KOH/g | 0.6 max. | 0.4 max. | 3.92 | 0.12 | 0.12 | b, c |
| Oxidation Stability (rotating bomb test) | D2112 | minutes | — | 195 | nm | nm | 210 | est., c |
| Oxidation Inhibitor Content | D4768 | wt % | 0.08 max. | 0.3 max. | 0 | 0.075 | 0.3 | c |
| Corrosive Sulfur | D1275 | | non-corrosive | non-corrosive | nm | non-corrosive | non-corrosive | c |
| Water | D1533 | ppm | 35 max. | 35 max. | nm | 38 | 38 | c |
| Neutralization Number, TAN | D974 | mg KOH/g | 0.03 | 0.03 | nm | <0.01 | <0.01 | est., c |
| PCB Content | D4059 | ppm | not detectable | not detectable | nm | not detectable | not detectable | c |

It was discovered that contacting a naphthenic base oil, a paraffinic base oil, and an amount of antioxidant agent of less than about 0.08 weight percent according to a process of the invention may provide for a resulting mineral insulating oil that meets ASTM D3487 (incorporated herein by reference) Type I mineral insulating oil requirements. Product B disclosed in Table 5 may generally meet the ASTM D3487 Type I mineral insulating oil requirements.

What is claimed is:

1. A mineral insulating oil comprising a naphthenic base oil, a paraffinic base oil, and a component selected from the group consisting of a pour point depressant, an anti-gassing agent, and combinations thereof, wherein the naphthenic base oil comprises a ratio of total sulfur to basic nitrogen of less than about 80:1 and a ratio of sulfide sulfur to basic nitrogen of greater than about 10:1, wherein the naphthenic base oil is present in an amount in a range of from about 60 weight percent to about 95 weight percent based on the total weight of the mineral insulating oil and further wherein the paraffinic base oil is present in an amount in a range of from about 5 weight percent to about 40 weight percent based on the total weight of the mineral insulating oil.

2. A mineral insulating oil according to claim 1 wherein the mineral insulating oil comprises a ratio of total sulfur to basic nitrogen of less than about 70:1.

3. A mineral insulating oil according to claim 1 further comprising an antioxidant agent.

4. A mineral insulating oil according to claim 3 wherein the antioxidant agent is present in an amount in a range of from about 0.01 weight percent to about 0.30 weight percent based on the total weight of the mineral insulating oil.

5. A mineral insulating oil according to claim 3 wherein the antioxidant agent is selected from the group consisting of hindered phenols, cinnamate type phenolic esters, alkylated diphenylamines, and combinations thereof.

6. A mineral insulating oil according to claim 3 further comprising a component selected from the group consisting of a pour point depressant, an anti-gassing agent, and combinations thereof.

7. A mineral insulating oil according to claim 1 comprising an aniline point in a range of from about 60° C. to about 100° C. (ASTM D611), a viscosity in a range of from about 6 $mm^2s^{-1}$ to about 12 $mm^2s^{-1}$ at 40° C. (ASTM D445), a flash point in a range of from about 135° C. to about 160° C. (ASTM test method D92), and a pour point of about −40° C. or lower (ASTM D5950).

8. A process for producing a mineral insulating oil comprising contacting a naphthenic base oil, a paraffinic base oil, and a component selected from the group consisting of a pour point depressant, an anti-gassing agent, and combinations thereof, wherein the naphthenic base oil comprises a ratio of total sulfur to basic nitrogen of less than about 80:1, wherein the naphthenic base oil is present in an amount in a range of from about 60 weight percent to about 95 weight percent based on the total weight of the mineral insulating oil and further wherein the paraffinic base oil is present in an amount in a range of from about 5 weight percent to about 40 weight percent based on the total weight of the mineral insulating oil.

9. A process according to claim 8 wherein the contacting comprises a temperature, a pressure, and a time period and further wherein the temperature is in a range of from about 5° C. to about 100° C., the pressure is in a range of from about 0 kPa to about 1460 kPa, and the time period is in a range of from about 0.25 hours to about 8 hours.

10. A process according to claim 8 further comprising contacting with an antioxidant agent.

11. A process according to claim 10 further comprising contacting with a component selected from the group consisting of a pour point depressant, an anti-gassing agent, and combinations thereof.

12. A process according to claim 8 wherein the paraffinic base oil comprises a ratio of total sulfur to basic nitrogen of less than about 80:1.

13. A process according to claim 8 wherein the naphthenic base oil is present in an amount in a range of from about 60 weight percent to about 95 weight percent based on the total weight of the mineral insulating oil and further wherein the paraffinic base oil is present in an amount in a range of from about 5 weight percent to about 40 weight percent based on the total weight of the mineral insulating oil.

14. A process according to claim 8 wherein the naphthenic base oil comprises an aniline point of at most about 110° C. (ASTM test method D611), a flash point of at least about 135° C. (ASTM test method D92), and a viscosity of at least about 7.0 $mm^2s^{-1}$ at 40° C. (ASTM test method D445).

15. A process according to claim 8 wherein the paraffinic base oil comprises an aniline point of at most about 105° C. (ASTM test method D611), a flash point of at least about 135° C. (ASTM test method D92), and a viscosity of at least about 10.0 $mm^2s^{-1}$ at 40° C. (ASTM test method D445).

16. A process according to claim 8 wherein the mineral insulating oil comprises an aniline point in a range of from about 60° C. to about 100° C. (ASTM D611), a viscosity in a range of from about 6 mm2s−1 to about 12 mm2s−1 at 40° C. (ASTM D445), a flash point in a range of from about 135° C. to about 160° C. (ASTM test method D92), and a pour point of about −40° C. or lower (ASTM D5950).

* * * * *